US007973816B2

(12) United States Patent
Kim

(10) Patent No.: US 7,973,816 B2
(45) Date of Patent: Jul. 5, 2011

(54) MOBILE IMAGE FORMING APPARATUS

(75) Inventor: Sin-ae Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1090 days.

(21) Appl. No.: 11/746,878

(22) Filed: May 10, 2007

(65) Prior Publication Data

US 2008/0024576 A1 Jan. 31, 2008

(30) Foreign Application Priority Data

Jul. 25, 2006 (KR) ..... 10-2006-0070026

(51) Int. Cl.

| | |
|---|---|
| ***B41J 2/01*** | (2006.01) |
| ***B41J 29/13*** | (2006.01) |
| ***B41J 11/00*** | (2006.01) |
| ***B41J 2/315*** | (2006.01) |
| ***B41J 2/325*** | (2006.01) |

(52) U.S. Cl. ..... 347/222; 347/104; 347/108; 347/218; 347/221

(58) Field of Classification Search ..... 347/104, 347/108, 218, 221, 222
See application file for complete search history.

(56) References Cited

U.S. PATENT DOCUMENTS

| | | | | |
|---|---|---|---|---|
| 4,853,711 | A * | 8/1989 | Piatt | 346/134 |
| 2005/0158111 | A1* | 7/2005 | Yang | 400/624 |
| 2005/0212896 | A1 | 9/2005 | Nishitani et al. | |
| 2006/0061644 | A1* | 3/2006 | Proulx et al. | 347/104 |

FOREIGN PATENT DOCUMENTS

| | | |
|---|---|---|
| JP | 10-157862 | 6/1998 |
| JP | 2001-260467 | 9/2001 |
| KR | 2003-35515 | 5/2003 |

OTHER PUBLICATIONS

Office Action issued in Chinese Patent Application No. 2007101282043 on May 8, 2009.

* cited by examiner

*Primary Examiner* — Matthew Luu
*Assistant Examiner* — Kendrick X Liu
(74) *Attorney, Agent, or Firm* — Staas & Halsey LLP

(57) ABSTRACT

An image forming apparatus includes an image forming unit which forms an image on a printing medium; a main body casing which accommodates the image forming unit; a feeding unit which feeds the stored medium to the image forming unit; and a rotation coupling unit which couples the feeding unit with the bottom surface of the main body casing to rotate at a predetermined angle with respect to the bottom surface of the main body casing.

15 Claims, 10 Drawing Sheets

MOBILE IMAGE FORMING APPARATUS

CROSS-REFERENCE TO RELATED APPLICATIONS

This application claims all benefits accruing under 35 U.S.C. §119 from Korean Patent Application No. 2006-70026, filed on Jul. 25, 2006 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a mobile image forming apparatus.

2. Related Art

In general, an image forming apparatus, such as a printer, a photocopier, a facsimile machine, or a multifunctional product, prints an image onto a printable medium according to image data supplied from a host apparatus. Image forming apparatuses generally are classified into an inkjet type, an electrophotographic type, and a dye sublimation type according to the method and function in which the image forming apparatus prints the image.

According to recent developments in technology, image forming apparatuses coupled to a portable host apparatus are now capable of transmitting and receiving image data directly. Due to the development and increasing use of portable digital cameras and cameraphones (mobile phones with camera functionality), users frequently desire to output the photo image data directly through the image forming apparatus.

These trends have led to the rapid development of image forming apparatuses designed to output photo image data exclusively. Dye sublimation type image forming apparatuses have been used most widely, since the resulting images are not as affected by moisture, last a longer period of time, and have a higher resolution than other types of image forming apparatuses.

However, a typical image forming apparatus designed to print photographs is usually large and bulky. As a result, users cannot easily carry the apparatus around or use the apparatus to print. In addition, a conventional photographic image forming apparatus is not equipped with the ability to store printable media; instead, the user must carry a separate printable medium storage unit and attach the two devices whenever the user wants to print an image.

SUMMARY OF THE INVENTION

Aspects of the invention provide a mobile image forming apparatus which can feed media automatically.

Additional aspects and/or advantages of the invention will be set forth in part in the description which follows and, in part, will be obvious from the description, or may be learned by practice of the invention.

According to one aspect of the present invention, an image forming apparatus is provided with a main body casing to house an image forming unit to form an image onto a printable medium; a feeding unit arranged below the main body casing to store the printable medium and to feed the printable medium to the image forming unit; and a rotation coupling unit to couple the feeding unit with a bottom surface of the main body casing and to rotate with respect to the bottom surface of the main body casing.

According to another aspect of the present invention, the rotation coupling unit rotates with respect to the main body casing between a waiting position where the feeding unit is positioned to be perpendicular with respect to the image forming unit and an initial printing position where the feeding unit is positioned to be parallel with the image forming unit and where the feeding unit is able to feed the printable medium to the image forming unit.

According to another aspect of the present invention, the rotation coupling unit comprises a rotation shaft to support the feeding unit so that the feeding unit can be rotated between the waiting position and the initial printing position.

According to another aspect of the present invention, the main body casing comprises a pick-up roller arranged within the main body casing to supply the printable medium stored in the feeding unit to the image forming unit, and wherein the rotation coupling unit further comprises a moving unit to moves the feeding unit to a final printing position where the leading edge of the medium stored in the feeding unit is in contact with the pick-up roller.

According to another aspect of the present invention, the moving unit comprises at least one guide shaft coupled to the main body casing and arranged perpendicular to the image forming unit, and a moving casing provided to be movable along the guide shaft.

According to another aspect of the present invention, the guide shaft is comprises a pair of shafts and the moving casing slides along the pair of shafts.

According to another aspect of the present invention, the lengths of the guide shafts are provided so that one end part of the feeding unit aligns with one side of the main body casing when the feeding unit moves along the shafts.

According to another aspect of the present invention, the image forming apparatus further comprises a guide roller provided on one side of the pick-up roller to transfer the printable medium picked up by the pick-up roller to the image forming unit.

According to another aspect of the present invention, the image forming apparatus further comprises a discharging slit disposed on one side of the main body casing to discharge the printable medium to the outside once the image forming unit has formed an image onto the printable medium.

According to another aspect of the present invention, the image forming apparatus further comprises a rotation sensor unit provided on one side of the feeding unit to detect a relative rotation of the feeding unit; and a controller to control the image forming unit to be preheated at a predetermined reference temperature if the rotation sensor unit detects the rotation of the feeding unit.

According to another aspect of the present invention, the controller drives the pick-up roller when if the rotation sensor unit detects the rotation of the feeding unit.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1A:
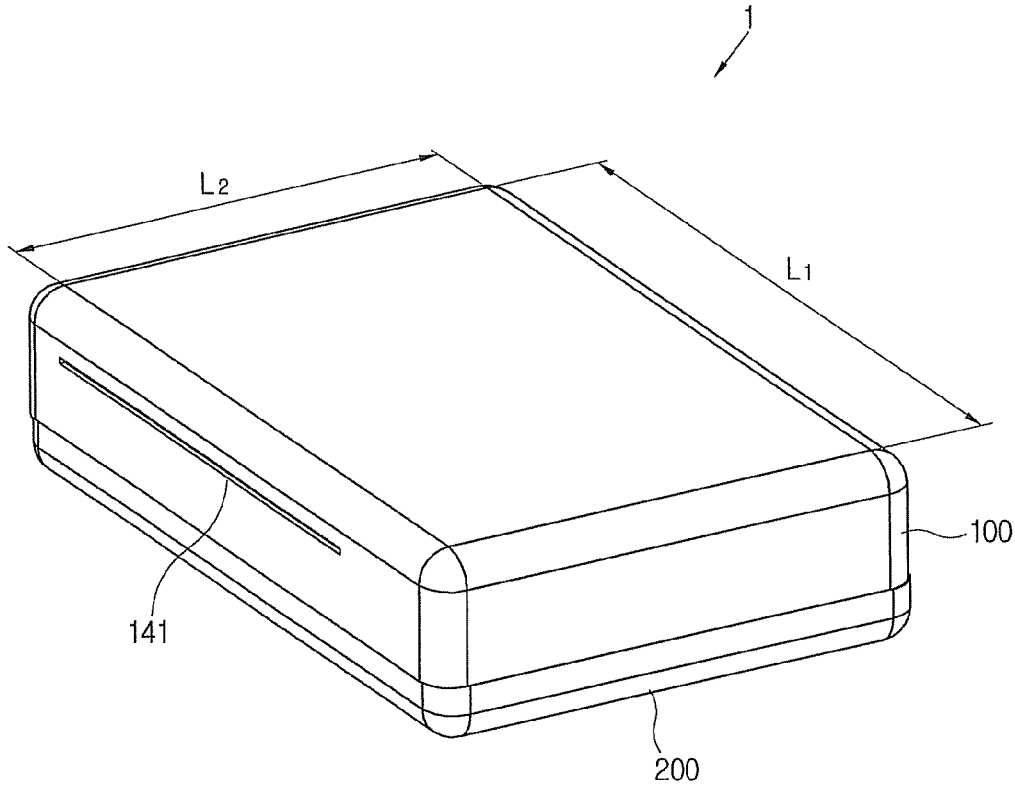
FIGS. 1A to 1C are a perspective view, a projected perspective view, and a sectional view showing a configuration of an image forming apparatus in a waiting position according to an example embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 1B:
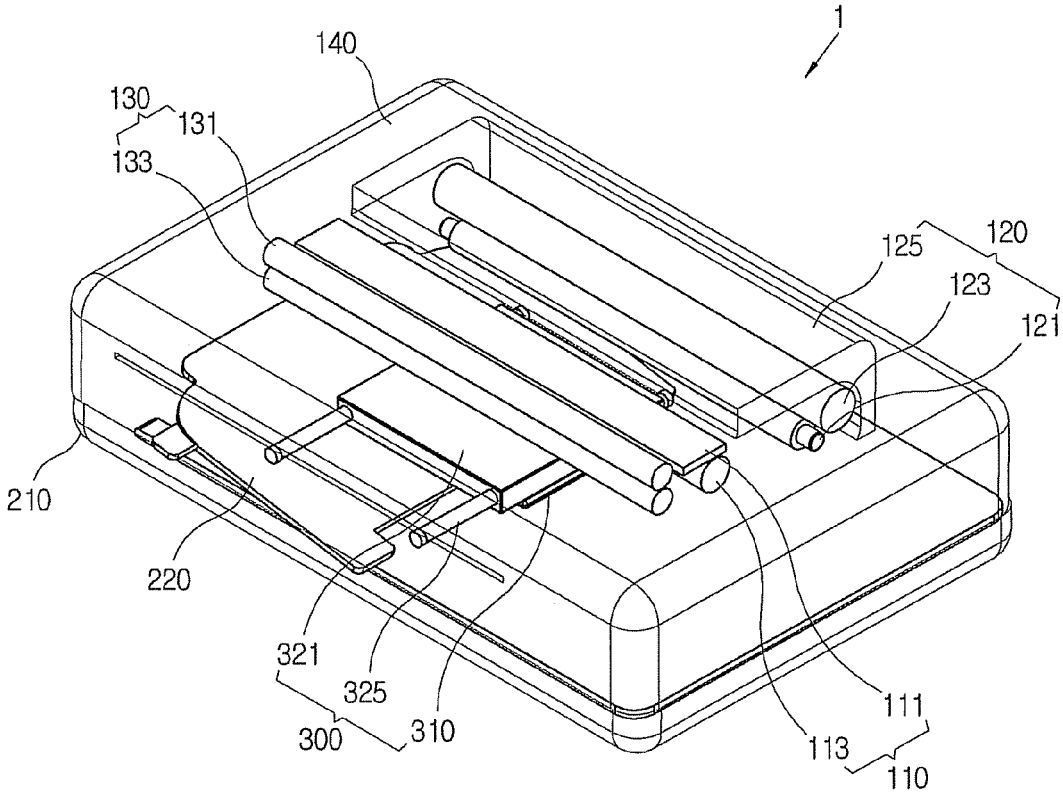
Figure 1C:
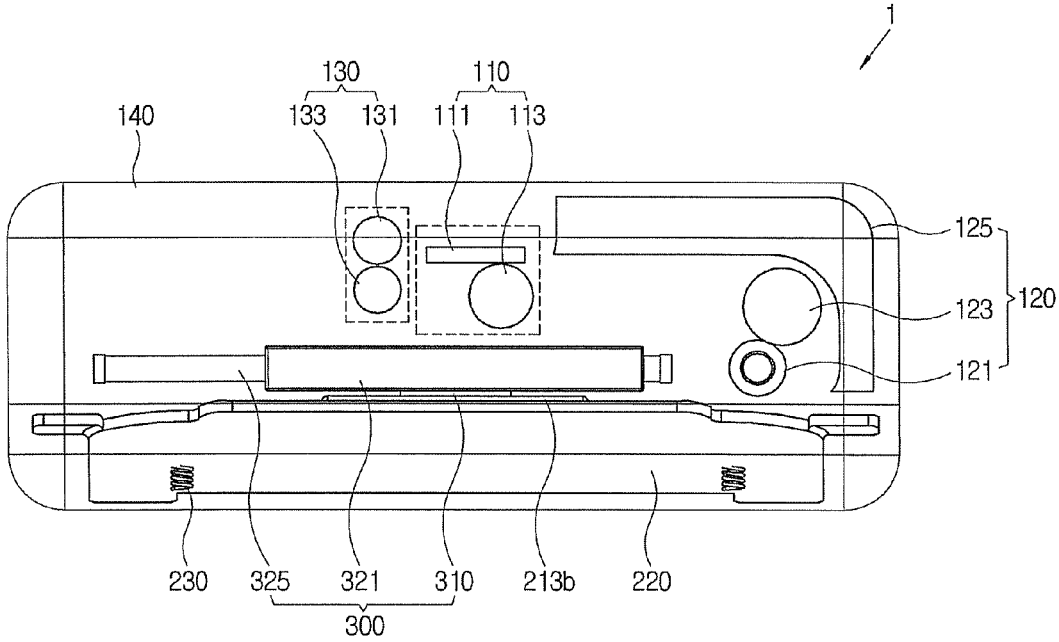

FIGS. 1A-1C shows an image forming apparatus according to an example embodiment of the present invention.

As shown in FIGS. 1A to 1C, image forming apparatus 1 comprises a main body 100, a feeding unit 200 to store printable media and capable of rotating relative to the main body 100, and a rotation coupling unit 300 to couple the main body 100 with the feeding unit 200 so that the feeding unit 200 can rotate with respect to the main body 100 or vice versa. According to various aspects of the invention, the main body 100 may rotate with respect to the feeding unit 200, the feeding unit 200 may rotate with respect to the main body 100, or both the feeding unit 200 and the main body 100 may rotate.

The main body 100 comprises an image forming unit 110 to form an image onto a printable medium based on image data received from a host apparatus (not shown), a feeding roller unit 120 to feed the printable medium stored in the feeding unit 200 to the image forming unit 110, a discharging roller unit 130 to discharge the printable medium on which the image is formed, and a main body casing 140 accommodating these components. The host apparatus may be a desktop computer, laptop computer, mobile computer (such as a personal digital assistant), mobile phone, camera, or a similar device.

The image forming unit 110 may be a dye sublimation type which applies heat to printable media having a thermal chromogenic layer to form an image on the printable media. As shown in FIG. 1B, the image forming unit 110 comprises a TPH (thermal print head) 111 applying heat and a platen roller 113 to press a printable medium against the TPH 111. According to other aspects of the invention, the image forming unit 110 may comprise other components as well.

The TPH 111 has a plurality of minute heating elements arranged at a predetermined interval corresponding to the width of the printable medium. The number of heating elements depends on the resolution of the image forming apparatus 1. The respective heating elements individually generate heat to form the image. In addition, the respective heating elements generate different temperatures since the respective colors of ink layers (yellow, magenta, and cyan) have different response temperatures.

A controller (not shown) preheats the TPH 111 to a reference temperature when a user rotates the feeding unit 200 and applies an input signal to the image forming apparatus 1 through an inputting unit (not shown). The reference temperature may correspond to the lowest temperature among the respective colors of ink layers at which the ink layers forms the image by being heated. The TPH 111 remains preheated at the reference temperature in a standby state and directly applies heat to form an image when the printable medium enters the image forming unit 110, thereby reducing image forming time.

The image forming unit 110 may be provided lengthwise (L1 direction shown in FIG. 1) relative to the main body casing 140. If the image forming unit 110 is provided widthwise (L2 direction in FIG. 1), the maximum width of images formed by the image forming unit 110 will be reduced because a cam driving the image forming unit 110 and a driver to drive the cam will partially overlap the printable medium. Accordingly, the image forming unit 110 may have a length corresponding to the width of the printable media stored in the feeding unit 200.

An image forming unit 110 according to another exemplary embodiment of present invention may employ a thermal transfer type which heats and pressurizes an ink ribbon coated with ink and transfers the ink to the printable medium. The image forming unit 110 employing a thermal transfer technique comprises a TPH 111 to apply heat and pressure to the printable medium, a platen roller 113 to press the media against the TPH 111, an ink ribbon supplying roller (not shown) to supply the ink ribbon (not shown) with ink, and an ink ribbon recycling roller to recycle the ink ribbon once the ink has been transferred onto the printable medium.

The main body of a thermal transfer image forming apparatus is larger than that of a dye sublimation image forming apparatus, since the main body must accommodate the ink ribbon supplying roller and the ink ribbon recycling roller. Although any type of image forming unit 110 may be used, the dye sublimation type is more desirable since the size of the main body 100 can be reduced.

The feeding roller unit 120 feeds the printable medium stored in the feeding unit 200 to the image forming unit 110. The feeding roller unit 120 comprises a pick-up roller 121 to pick up the printable medium stored in the feeding unit 200 and a guide roller 123 to guide the printable medium picked up by the pick-up roller 121 to the image forming unit 110.

The pick-up roller 121 provides a friction force to the printable medium stored in the feeding unit 200 to pick up the printable medium. The pick-up roller 121 is driven by a controller (not shown). The pick-up roller 121 may have a material property and a thickness to generate a proper friction force based on the kind, the thickness, and the resistance characteristics of the printable medium.

The guide roller 123 guides the media picked up from the pick-up roller 121 to the image forming unit 110 by rotating with the pick-up roller 121. In general, the printable medium picked up by the pick-up roller 121 tends to move in a straight line tangential to the pick-up roller 121. To prevent the printable medium from bumping into a wall surface of the main body casing 140, the guide roller 123 is in contact with the pick-up roller 121 to guide the media picked up by the pick-up roller 121 to the image forming unit 110. The guide roller 123 may be provided in a place where a curvature is suddenly changed or on one side of an internal wall surface so that the printable medium can be transferred to the image forming unit 110 without bumping into the internal wall surface of the main body casing 140. A plurality of guide rollers 123 may be installed for this purpose.

A guide member 125 may be disposed on the internal wall surface of the main body casing 140 near the guide roller 123. The guide member 125 reduces the space between the guide roller 123 and the internal wall surface to limit the possible motion of the printable medium. The guide member 125 may be formed with a curved surface corresponding to a transferring path through which the media will be transferred to guide the printable medium toward the image forming unit 110 once the printable medium has passed through the guide roller 123.

The feeding roller unit 120 may comprise a transferring feeding roller (not shown) disposed between the guide roller 123 and the image forming unit 110 to guide the printable medium to the image forming unit 110. The transferring feeding roller may be provided as a pair of rollers and the transferring feeding roller may be selected based on the sizes of the main body 100 and the printable medium.

Figure 3A:
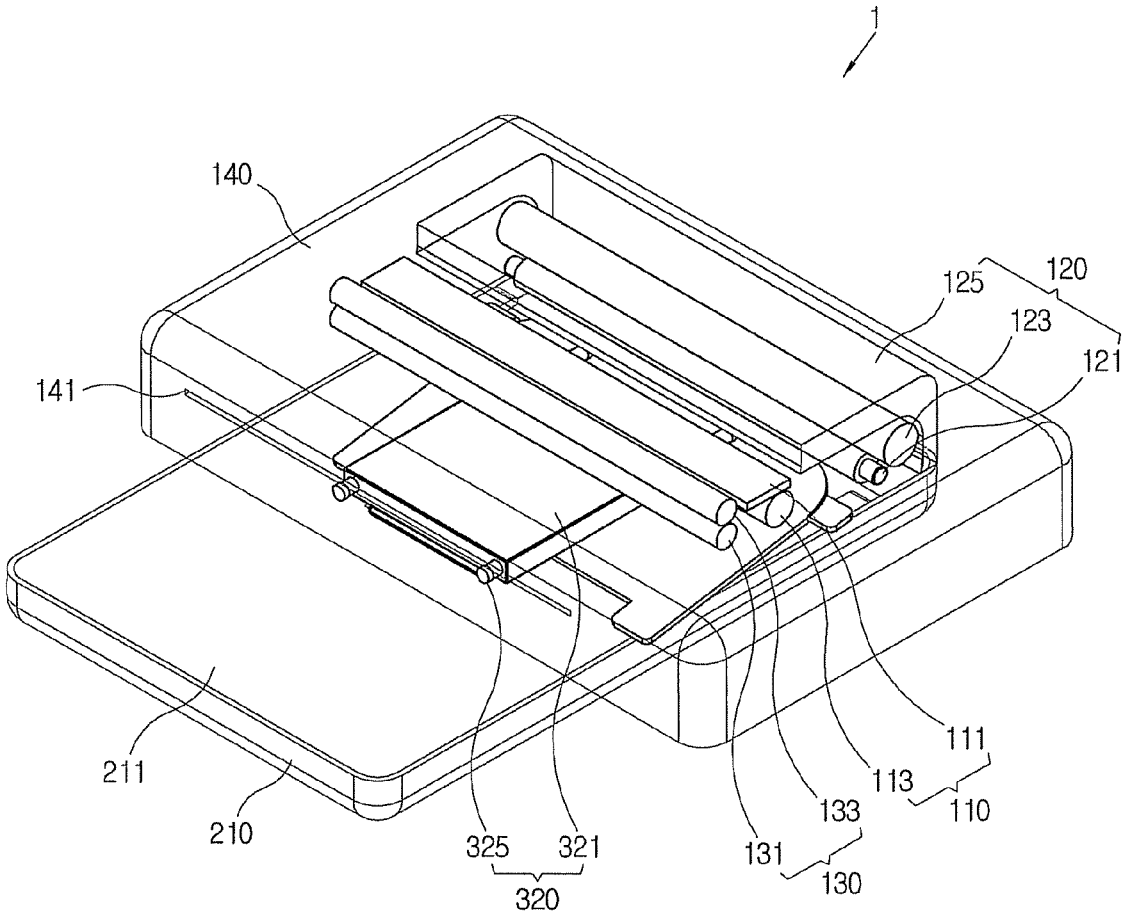
FIGS. 3A and 3B are a perspective view, a projected perspective view, and a sectional view showing a configuration of an image forming apparatus performing printing according to an example embodiment of the present invention.
Figure 3B:
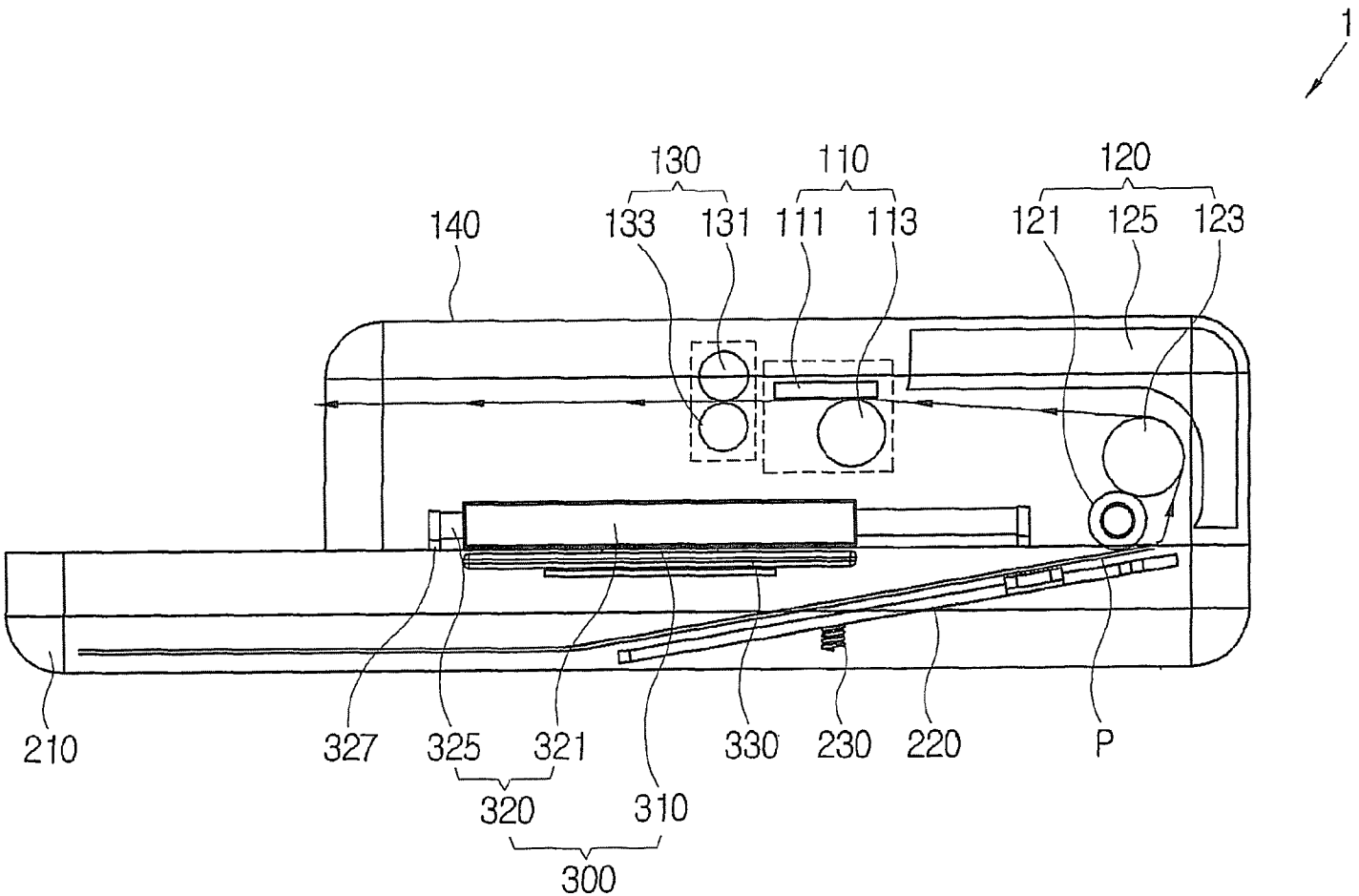

As shown in FIG. 3B, the discharging roller unit 130 guides the printable medium to the outside once the image forming unit 110 has formed an image onto the printable medium. The discharging roller unit 130 comprises a transferring roller 131 and a pressing roller 133 engaged with the transferring roller 131 to press the image-formed media. The pressing roller 133 presses the media so that the media can be discharged to the outside stably. The number and position of the discharging roller unit 130 may depend on the distance between the image forming unit 110 and a discharging slit 141 (shown in FIG. 1A).

The feeding roller unit 120 and the discharging roller unit 130 are disposed so as to support each respective end of the printable medium while the image forming unit 110 forms an image onto the printable medium. The transferring rollers 131 and the transferring feeding rollers (not shown) may rotate forward or backward as the image forming unit 110 moves the printable medium forward and backward during the image forming process, if the image forming unit uses ink ribbons to form the image onto the printable medium.

The main body casing 140 accommodates the image forming unit 110, the feeding roller unit 120, and the discharging roller unit 130. The main body casing 140 is coupled to the feeding unit 200 so as to allow the feeding unit 200 to rotate relative to the main body 100. The discharging slit 141 is provided on one side of the main body casing 140. A rotation shaft accommodating hole (not shown), into which a rotation shaft 310 of the rotation coupling unit 300 is inserted, is provided on the bottom surface of the main body casing 140. The main body casing 140 may comprise an inputting unit (not shown) to receive an input signal from a user and a communication unit (not shown) to receive image data from a host apparatus.

The discharging slit 141 is provided on one side of the main body casing 140. The discharging slit 141 discharges the printable medium upon which an image has been formed to the outside. The discharging slit 141 may correspond to the thickness and the size of the printable medium. In particular, the thickness of the discharging slit 141 may be based on an image forming technique of the image forming unit 110 since a printable medium with a chromogenic layer is larger than a general-purpose printable medium. In addition, the length of the discharging slit 141 may be longer than the width of the media so as to reduce interference when the printable medium is discharged. Also, more length may be needed to move the printable medium media back and forth if the image forming unit 110 uses an ink ribbon.

The inputting unit (not shown) may be provided in an external unit of the main body casing 140. The inputting unit may be a touch screen, a plurality of inputting panels, or other device allowing user input. The communication unit (not shown) may be provided on an external side of the main body casing 140 to receive image data from the host apparatus (not shown). The communication unit may be a connector to connect with the host apparatus directly or a wireless communication unit to communicate with the host apparatus wirelessly. The connector may be a USB (universal serial bus) port to connect with a cellular phone, a digital camera, or a computer. The radio communication unit may be provided through a radio network such as Bluetooth or an RFID (Radio Frequency Identification). The connector according to other aspects of the present invention may use any type of communication technology.

Figure 2A:
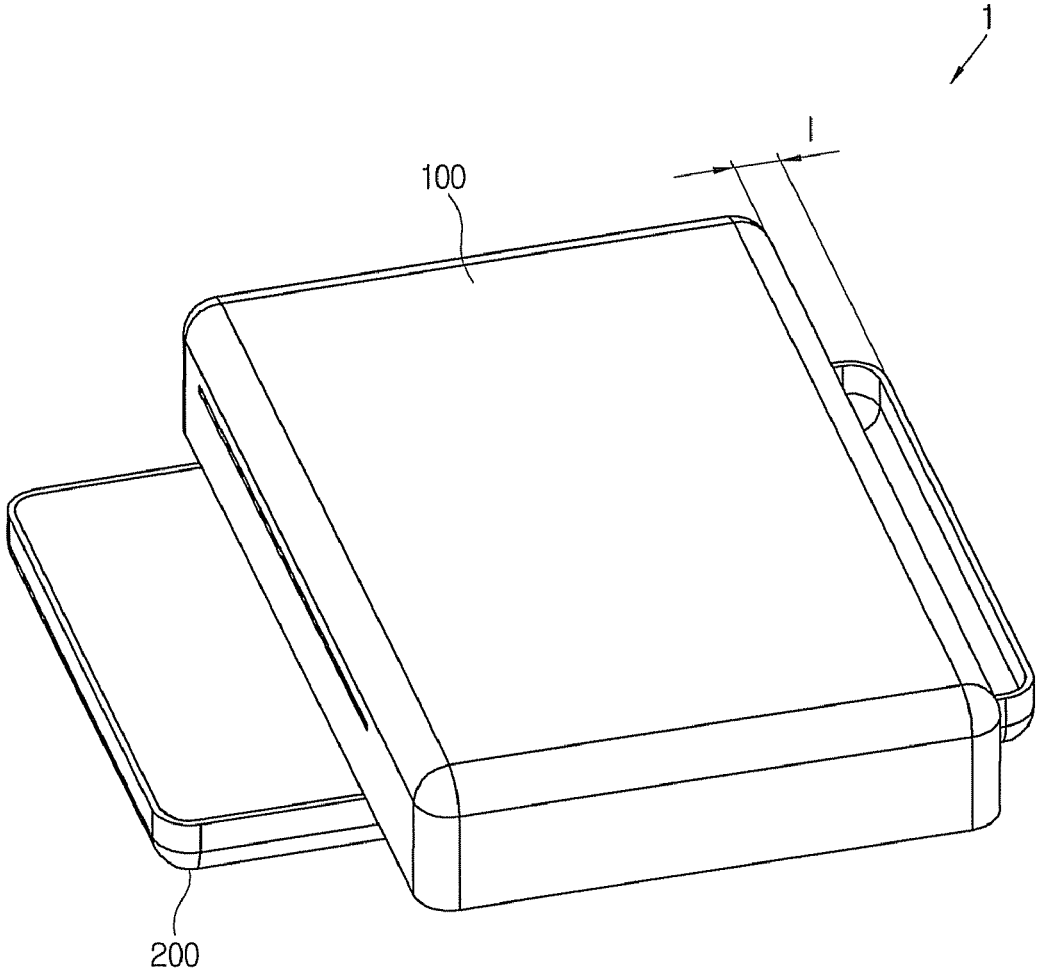
FIGS. 2A to 2C are a perspective view, a projected perspective view, and a sectional view showing a configuration of an image forming apparatus under rotation according to an example embodiment of the present invention.

As shown in FIGS. 1A and 2A, the feeding unit 200 may rotate between a waiting position parallel to the main body 100 (FIG. 1A) and an initial printing position perpendicular to the main body 100 to supply the printable medium to the main body 100 (FIG. 2A). As shown in FIG. 3, the feeding unit 200 comprises a feeding cassette 210 in which the printable medium is stored, a knock-up plate 220 provided on one side of the feeding cassette 210 to bring the printable medium into contact with the pick-up roller 121, and an elastic member 230 to press the knock-up plate 220 against the pick-up roller 121. The feeding cassette 210 can store a plurality of printable media. The higher the feeding cassette 210's capacity, the larger the feeding cassette 210. As a result, the size of the feeding cassette may depend on the size of an individual printable medium, the intended capacity of the feeding cassette, and the desired size of the image forming apparatus 1.

Figure 2B:
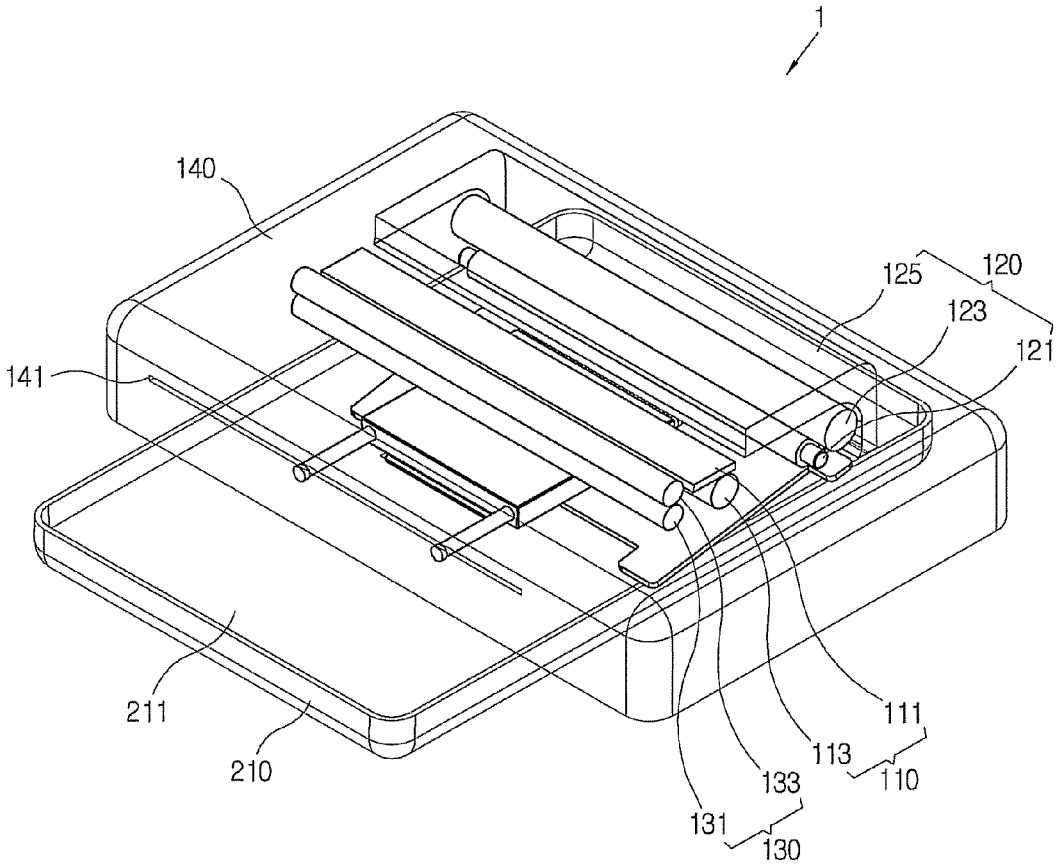

The main body contact surface 211, shown in FIG. 2B, is the surface of the feeding cassette 210 that is in contact with the main body 100. The main body contact surface 211 supports the rotation of the feeding unit 200 by remaining in contact with the bottom surface of the main body casing 140 while the feeding unit 200 rotates with respect to the main body 100 about a rotation shaft 310. The main body contact surface 211 may also block the inflow of dust from the outside during the printing process, keeping the printable medium clean.

The main body contact surface 211 may have a rotation shaft inserting hole (not shown) in which the rotation shaft 310 is inserted while the feeding unit 200 rotates with respect to the main body 100. The rotation shaft inserting hole may be larger than the diameter of the rotation shaft 310 so that the feeding unit 200 can rotate smoothly. The main body contact surface 211 may be provided so that a partial area of the upper surface of the feeding cassette 210 is open. The open area allows the front edge of the printable medium stored on the knock-up plate 220 to come into contact with the pick-up roller 121.

A rotation sensor unit (not shown) may be provided on one side of the main body contact surface 211 to detect the rotation of the feeding unit 200. The rotation sensor unit may be a contact sensor or the like. The rotation sensor unit is in contact with the main body casing 140 and if the main body casing 140 rotates relative to the feeding unit 200, the rotation sensor unit detects the rotation of the main body casing 140, thereby detecting the rotation of the feeding unit 200. After the rotation sensor unit detects the rotation of the feeding unit 200, it informs the controller (not shown) of the result. According to other aspects of the invention, the rotation sensor unit may employ other known configurations to detect the relative rotation of the main body 100 and the feeding unit 200.

The knock-up plate 220 stores printable media on its upper surface and is pushed upward by the elastic member 230. The knock-up plate 220 puts the printable media into contacted with the pick-up roller 121 while the feeding unit 200 in the initial printing position or in a final printing position (described below).

Figure 4A:
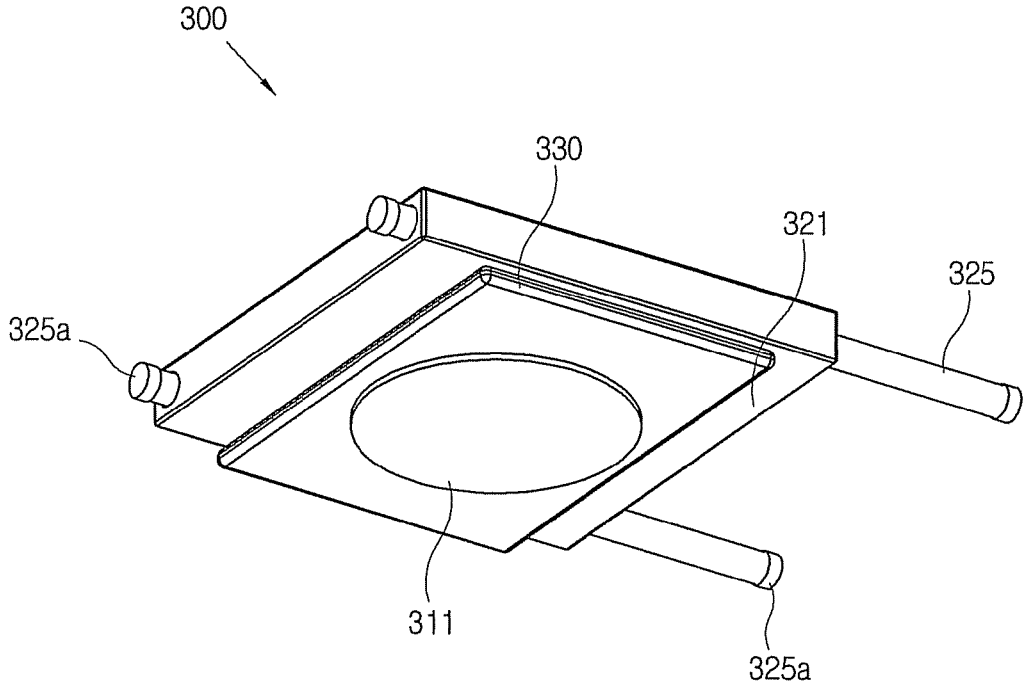
FIGS. 4A and 4B are a perspective view and a sectional view illustrating a configuration of a rotation coupling unit according to an example embodiment of the present invention.
Figure 4B:
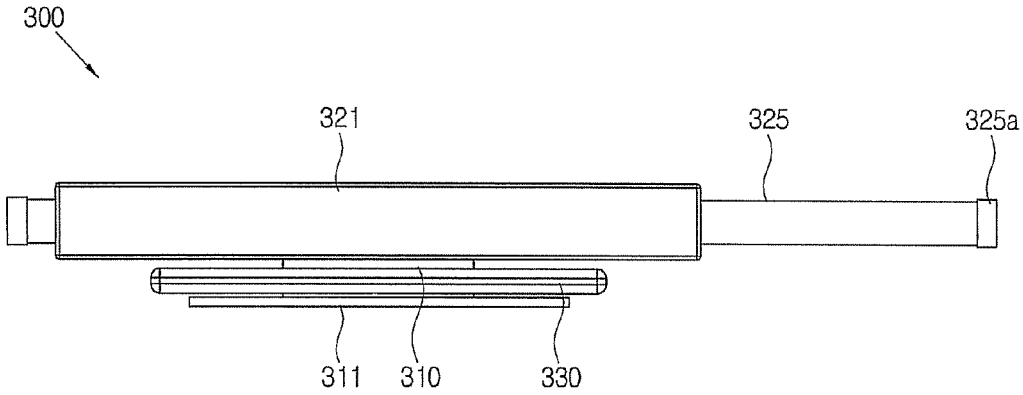

The rotation coupling unit 300 couples the feeding unit 200 with the main body 100 so that the feeding unit 200 can rotate to or from the initial printing position. As shown in FIGS. 4A and 4B, the rotation coupling unit 300 comprises the rotation shaft 310 coupling the main body 100 with the feeding unit 200, a moving unit 320 provided on one side of the main body 100 to permit the rotation shaft 310 to rotate the feeding unit 200 to the initial printing position, and a feeding unit coupling unit 330 provided on one side of the feeding unit 200 to couple the rotation shaft 310 to the feeding unit 200.

The rotation shaft 310 passes through the rotation shaft accommodating hole (not shown) of the main body casing 140 and the rotation shaft inserting hole of the main body contact surface 211 and enables the main body casing 140 and the feeding cassette 210 to rotate. Accordingly, the user can rotate at least one of the feeding cassette 200 and the main body 100 with respect to the rotation shaft 310. The rotation shaft 310 has a predetermined diameter and is coupled to the moving unit 321 and the feeding unit coupling unit 330.

A stopper (not shown), may be provided on one side of the rotation shaft 310 to limit the rotation of the feeding cassette 210. The stopper, which is projected from a planar surface of the rotation shaft 310, prevents continued rotation once the feeding cassette 210 (which is part of the feeding unit 200) has rotated to either the waiting position or the initial printing position. The stopper also prevents the feeding unit 200 from being misaligned during the printing process due to accidental rotation as the result of an external shock.

The rotation shaft 310 allows the feeding unit 200 to rotate by the user's pressure and may be provided to automatically rotate in a standby state according to the user's outputting signal. For example, a motor may be coupled to the rotation shaft 310 to automatically rotate either the main body 100 or the feeding unit 200. A stepping motor may be used to precisely control the rotation. The rotation shaft 310 is coupled to the main body 100 and the feeding cassette 210 so that at least one of the main body 100 and the feeding cassette 210 can rotate, but may also be shifted along the bottom surface of the main body casing 140 so that the feeding cassette 210 can move to a final printing position as necessary.

The moving unit 320 shifts the feeding cassette 210 to the final printing position after the feeding cassette 210 has rotated to the initial printing position (perpendicular to the main body 100). As shown in FIG. 1A, the main body casing 140 and the feeding cassette 210 may have a different transverse length L1 and a different perpendicular length L2. As a result, when the feeding cassette 210 is in the initial printing position, part of the feeding cassette 210 may project beyond of the main body 100 when the feeding cassette 210 is rotated to the initial printing position, as shown in FIG. 2A. Since the front edge of the printable medium stored in the feeding cassette 210 would not then be in contact with the pick-up roller 121, the pick-up roller cannot feed the printable medium to the guide roller 123 properly. Accordingly, the moving unit 320 shifts the feeding unit 200 to the final printing position shown in FIG. 2B, bringing the front edge of the printable medium into contact with the pick-up roller 121.

As shown in FIG. 4B, the moving unit 320 comprises a pair of guide shafts 325 coupled to the main body 100 and a transfer casing 321 to accommodate the rotation shaft 310 and to move along the guide shafts 325. Part of the guide shafts 325 are inserted into the transfer casing 321. The part which is not inserted into the transfer casing 321 corresponds to the length of the section of the feeding unit 200 projected to the outside when the feeding unit 200 is in the initial printing position. The guide shafts 325 are coupled to the bottom surface of the main body casing 140 by a coupling member 327 (FIG. 3B). Shock absorbing member 325*a*, composed of a shock-absorbing material such as rubber, may be provided on opposite sides of the guide shafts 325 so as to reduce shock caused when the transfer casing 321 moves.

The transfer casing 321 is in the shape of a casing to accommodate the rotation shaft 310 so that the feeding unit 200 can rotate and accommodates the motion of the guide shafts 325. Here, the transfer casing 321 may have a guide shaft accommodating hole (not shown) larger than the diameters of the guide shafts 325 so that the transfer casing 321 can slide along the guide shafts 325.

The feeding unit coupling unit 330 coupled to the main body contact surface 211 of the feeding cassette 210 enables the feeding unit 200 to rotate with respect to the rotation shaft 310. As shown in FIG. 4B, the feeding unit coupling unit 330 is larger than the diameter of the rotation shaft 310 coupled to the main body contact surface 211. The feeding unit coupling unit 330 may be coupled to the main body contact surface 211 in any fashion, such as an adhesive agent coupling, a spiral coupling, or the like. The rotation shaft 310 can stably couple the feeding unit 200 with the main body 100, since a rotation shaft supporting unit 311, larger than the diameter of the rotation shaft 310, is coupled to the lower unit of the feeding unit coupling unit 330.

As described above, the image forming apparatus 1 according to an example embodiment of the present invention may comprise a controller (not shown) to control the respective configurations according to the relative rotation of the main body 100 and the feeding unit 200. The controller drives the image forming unit 110, the feeding roller unit 120, and the discharging roller unit 130 to form an image on the media when the rotation sensor unit (not shown) determines that the feeding unit 200 is in the printing position. Particularly, the controller preheats the TPH 111 of the image forming unit 110 to form the image on the printing medium when the printing medium is fed.

An operation process of the image forming apparatus 1 with the above configurations will be described by referring to FIGS. 1A to 3B. First, as shown in FIG. 1A, when a user pushes the image forming apparatus 1 while the apparatus 1 is in the waiting condition, the feeding unit 200 rotates with respect to the main body 100 to the initial printing position. As shown in FIG. 2A, the rotated feeding unit 200 is projected to the outside by a length 1.

Figure 2C:
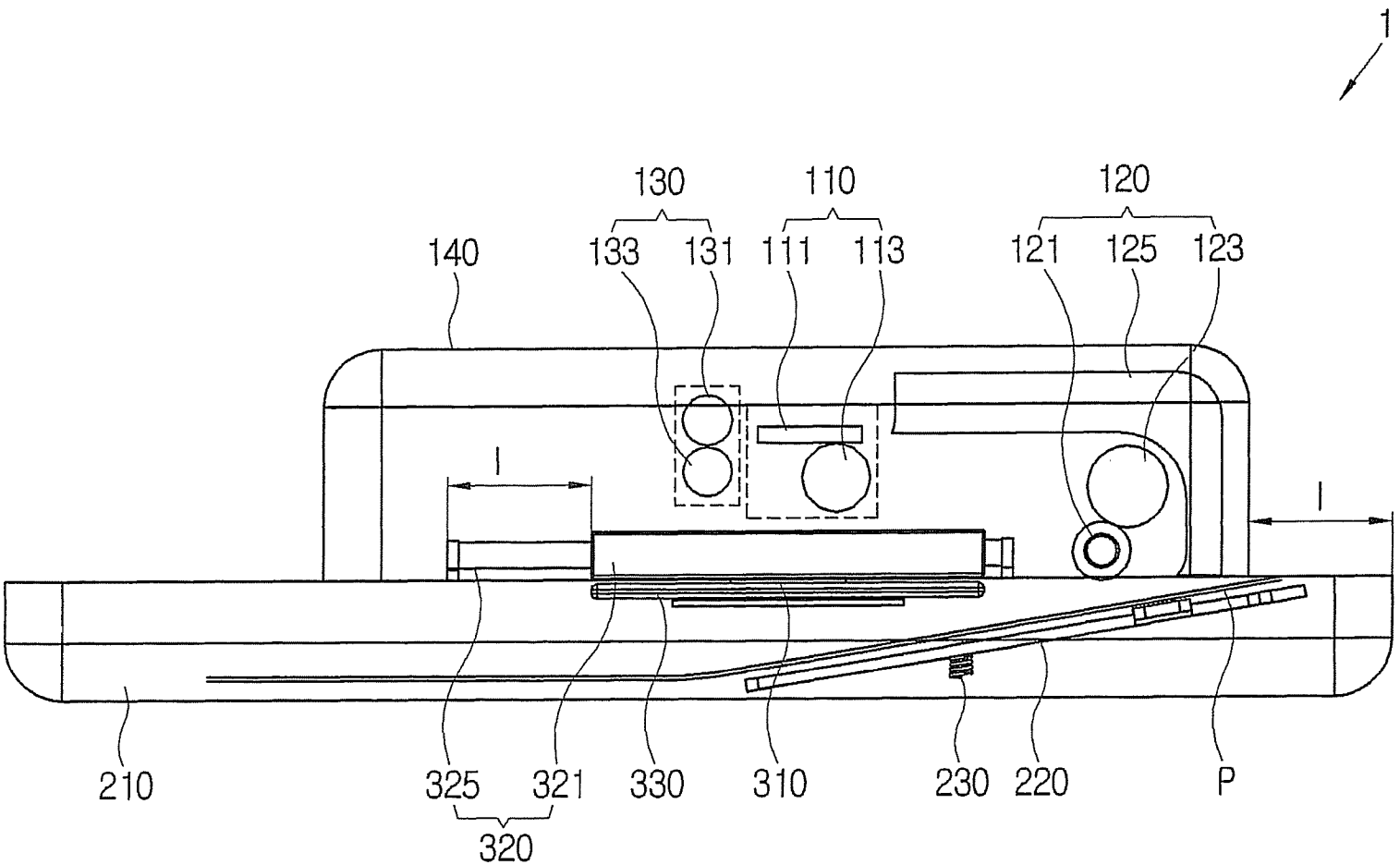

The user pushes the feeding unit 200 to the final printing position so that the end of the feeding unit 200 lines up with the corresponding side of the main body 100. As shown in FIG. 2C, the transfer casing 321 moves along the guide shafts 325 and the feeding unit 200 shifts into the final printing position shown in FIG. 3B. The rotation sensor unit (not shown) provided on one side of the feeding unit 200 (or on one side of the main body 100) informs the controller of the rotation of the feeding unit 200. Accordingly, the controller preheats the image forming unit 110 to the reference temperature and drives the pick-up roller 211 to begin the image forming process.

The printable medium stored on the knock-up plate 220 is fed to the main body 100 by the driving of the pick-up roller 211. The printable medium is then guided to the image forming unit 110 by the guide roller 123 and the guide member 125 as shown in a direction indicated by an arrow in FIG. 3B. The image forming unit 110 applies heat corresponding to the thermal chromogenic layers of the printable medium and forms an image onto the printing medium. Finally, the image-formed media is transferred to the discharge roller unit 130, and discharged to the outside through the discharging slit 141.

As described above, in an image forming apparatus according to aspects of the present invention, since the main body and the feeding unit are integrally provided, the user need not carry an extra feeding cassette. Also, as the overall size of the image forming apparatus can be minimized, the user can output an image data whenever necessary, even while carrying the image forming apparatus around.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, a method of preparing an image forming apparatus for printing may comprise rotating the feeding unit to the initial printing position where the feeding unit is perpendicular to the image forming unit and moving the feeding unit to a final printing position where one end of the feeding unit is aligned with one side of the image forming unit and where the feeding unit is able to feed the printable medium to the image forming unit so that the image forming unit is able to form an image onto the printable medium. Accordingly, it is intended, therefore, that the present invention not be limited to the various example embodiments disclosed, but that the present invention includes all embodiments falling within the scope of the appended claims.

What is claimed is:

1. An image forming apparatus, comprising:

a main body casing to house an image forming unit to form an image onto a printable medium;

a feeding unit arranged below the main body casing to store the printable medium and to feed the printable medium to the image forming unit;

a rotation coupling unit to couple the feeding unit with a bottom surface of the main body casing and to rotate with respect to the bottom surface of the main body casing;

a rotation sensor unit provided on one side of the feeding unit to detect a relative rotation of the feeding unit; and a controller arranged within the main body casing to control the image forming unit to be preheated at a predetermined reference temperature if the rotation sensor unit detects the rotation of the feeding unit.

2. The image forming apparatus according to claim 1, wherein the rotation coupling unit rotates with respect to the main body casing between a waiting position where the feeding unit is positioned to be perpendicular with respect to the image forming unit and an initial printing position where the feeding unit is positioned to be parallel with the image forming unit and where the feeding unit is able to feed the printable medium to the image forming unit.

3. The image forming apparatus according to claim 2, wherein the rotation coupling unit comprises a rotation shaft to support the feeding unit so that the feeding unit can be rotated between the waiting position and the initial printing position.

4. The image forming apparatus according to claim 2, wherein the main body casing comprises:

a pick-up roller arranged within the main body casing to supply the printable medium stored in the feeding unit to the image forming unit; and wherein the rotation coupling unit further comprises a moving unit to move the feeding unit to a final printing position where the leading edge of the printable medium stored in the feeding unit is in contact with the pick-up roller.

5. The image forming apparatus according to claim 2, further comprising a stopper disposed on a side of the rotation shaft to prevent continued rotation of the feeding unit beyond the initial printing position and to prevent continued rotation of the feeding unit beyond the waiting position.

6. The image forming apparatus according to claim 1, further comprising a discharging slit disposed on one side of the main body casing to discharge the printable medium to the outside once the image forming unit has formed an image onto the printable medium.

7. The image forming apparatus according to claim 1, wherein the controller drives the pick-up roller if the rotation sensor unit detects the rotation of the feeding unit.

8. The image forming apparatus according to claim 1, wherein the main body casing further comprises an inputting unit coupled to the main body casing to receive commands from a user.

9. The image forming apparatus according to claim 1, further comprising a communication unit coupled to the main body case to receive image data from a host apparatus to be printed onto the printable medium.

10. The image forming apparatus according to claim 1, further comprising a controller arranged within the main body casing to control operation of the image forming apparatus and to control the rotation of the feeding unit.

11. An image forming apparatus, comprising:

a main body casing to house an image forming unit to form an image onto a printable medium;

a feeding unit arranged below the main body casing to store the printable medium and to feed the printable medium to the image forming unit;

a rotation coupling unit to couple the feeding unit with a bottom surface of the main body casing and to rotate with respect to the bottom surface of the main body casing, the rotation coupling unit rotating with respect to the main body casing between a waiting position where the feeding unit is positioned to be perpendicular with respect to the image forming unit and an initial printing position where the feeding unit is positioned to be parallel with the image forming unit and where the feeding unit is able to feed the printable medium to the image forming unit;

a pick-up roller arranged within the main body casing to supply the printable medium stored in the feeding unit to the image forming unit; and a moving unit formed in the rotation coupling unit to move the feeding unit to a final printing position where the leading edge of the printable medium stored in the feeding unit is in contact with the pick-up roller, the moving unit including at least one guide shaft coupled to the main body casing and arranged perpendicular to the image forming unit, and a moving casing provided to be movable along the guide shaft.

12. The image forming apparatus according to claim 11, wherein the guide shaft comprises a pair of shafts and the moving casing slides along the pair of shafts.

13. The image forming apparatus according to claim 12, wherein the lengths of the pair of shafts are provided so that one end unit of the feeding unit aligns with one side of the main body casing when the feeding unit moves along the pair of shafts.

14. The image forming apparatus according to claim 12, further comprising a guide roller provided on one side of the pick-up roller to transfer the printable medium picked up by the pick-up roller to the image forming unit.

15. The image forming apparatus according to claim 12, further comprising a motor to rotate the feeding unit between the waiting position and the initial printing position automatically and to move the feeding unit between the initial printing position and the final printing position automatically.

* * * * *